US005372386A

United States Patent [19]

Mills

[11] Patent Number: 5,372,386

[45] Date of Patent: Dec. 13, 1994

[54] AUTOMATED RECONCILIATION SYSTEM

[76] Inventor: William B. Mills, 65 E. Washington St., Apartment #4207, No. Attleboro, Mass. 02760

[21] Appl. No.: 195,637

[22] Filed: Feb. 15, 1994

Related U.S. Application Data

[63] Continuation-in-part of Ser. No. 157,418, Nov. 26, 1993.

[51] Int. Cl.[5] ..... B42D 15/00

[52] U.S. Cl. ..... 283/67; 283/103; 283/105; 235/385; 340/825.34

[58] Field of Search ..... 283/67, 70, 94, 100, 283/101, 103, 105, 72; 235/375, 385, 449; 340/825.34

[56] References Cited

U.S. PATENT DOCUMENTS

| | | | |
|---|---|---|---|
| 402,136 | 4/1889 | Brain | 283/103 |
| 480,423 | 8/1892 | Crowell | 283/67 |
| 480,424 | 8/1892 | Crowell | 283/67 |
| 607,339 | 7/1898 | Burland | 283/105 |
| 733,218 | 7/1903 | Kitsee | 283/105 |
| 965,362 | 7/1910 | Beals | 283/100 |
| 4,816,824 | 3/1989 | Katz et al. | 340/825.340 |
| 4,836,378 | 6/1989 | Lephardt | 206/459.1 |

*Primary Examiner*—Richard K. Seidel
*Assistant Examiner*—Hwei-Siu Payer
*Attorney, Agent, or Firm*—Barlow & Barlow, Ltd.

[57] ABSTRACT

An automated reconciliation system that permits instantaneous reconciliation of unsold product units. A pull tab, which contains hidden reconciliation data is affixed to a product unit. To reconcile the particular product unit, a vendor removes the pull tab strip thereby defacing and destroying the product unit to expose the reconciliation data needed for entry into a central computer system. Alternatively, concealed reconciliation data may be printed directly on the product or its packaging in a fashion which requires the product to be opened to expose the reconciliation data. Such an opened condition, with a broken seal or opened wrapping, renders the product unsaleable. The automated reconciliation system ensures that unsold product units which receive reconciliation credit and reimbursement are not fraudulently resold.

44 Claims, 5 Drawing Sheets

AUTOMATED RECONCILIATION SYSTEM

This application is a continuation-in-part of U.S. patent application Ser. No. 08/157,418 filed on Nov. 26, 1993, now abandoned.

BACKGROUND OF THE INVENTION

The present invention relates generally to an automated reconciliation system. More specifically, the present invention relates to a system for the reconciliation by a retail or wholesale vendor of products which have become unsaleable due to their passing date of expiration, or by their lack of popularity with consumers. Such items include publications, foodstuffs, tobacco products, paper goods, drugs and electronic media.

In the consumer products industry, goods are typically sold at discounted price and distributed from manufacturer to retail vendor, with title to the goods passing to the vendor. An exception to this is the publishing industry, where newspapers, magazines, and paperback books are typically sold on a consignment basis by the vendor. A vendor of publications must go through a reconciliation process with the publisher to be reimbursed for unsold copies.

This reconciliation process is common for vendors of daily newspapers. Typically, at the end of the day, a vendor has a number of unsold copies remaining. The masthead off of the front of each unsold newspaper must be cut or torn off and mailed back to the publisher for reimbursement. It is not uncommon for a newspaper publisher, for example, to receive thousands of torn mastheads every day requiring manual reconciliation. This known system of reconciliation of publications requires the publisher, or intermediary wholesaler or distributor, to employ large numbers of customer service and accounting personnel for tabulating and reconciling torn mastheads and the like. As a result, it often takes weeks before the vendor is reimbursed for the unsold publications. Further, vendors typically order only what they are sure they will sell due to the tedious reconciliation process and the significant delays in reimbursement.

Due to the foregoing disadvantages of known reconciliation systems, as seen in those employed by the publishing industry, it is desirous for a vendor of a consumer product to be able to quickly and easily reconcile unsold product units and receive prompt reimbursement therefor. Additionally, a computerized reconciliation system is desirable to automate the entire process to greatly improve speed and accuracy of reconciliation.

Further, an automated system of reconciliation would offer significant advantages to manufacturers and vendors of mass consumer products, such as tobacco, over-the-counter or prescription drugs, greeting cards, electronic media, and the like, which are today typically sold at a discounted price and distributed from manufacturer to retail vendor, with ownership resting with the vendor. Such a system, permitting instantaneous and secure reconciliation of unsold product units, would greatly simplify the task of marketing these goods on a consignment basis, or with the option of automated reconciliation of unsold units.

SUMMARY OF THE INVENTION

The present invention preserves the advantages of prior art reconciliation systems. In addition, it provides new advantages not found in currently available reconciliation systems, and overcomes many of the disadvantages of such currently available systems.

The invention is generally directed to a novel and unique automated reconciliation system with particular application in reconciling publications, food products, tobacco products, drugs, and other consumer products. The reconciliation system of the present invention enables instantaneous and accurate reconciliation of unsold units of the consumer product. The novel system enables instantaneous reconciliation credit for a vendor. The present invention provides control over fraudulent reconciliation and prevents units that have been actually sold from being reconciled for credit. In addition, the novel system controls whether a particular vendor is authorized to reconcile for credit a particular product unit.

The preferred embodiment of the automated reconciliation system of the present invention includes a pull tab member which is a sheet of material affixed directly to the product. Hidden information, in the form of a serial number, bar code or magnetic strip, is disposed between the pull tab and the product.

In a publication application of the invention, the pull tab is preferably affixed along the central fold or spine of the publication in such as way as to conceal the serial number or bar code from view. To expose the serial number or bar code, the pull tab is pulled, tearing a strip of the publication with it thereby irreparably defacing the publication upon removal. Once the pull tab strip has been removed, the portion of the publication adhered to the pull tab in the vicinity of the serial number or bar code can then be removed to expose the serial number or bar code within view. This serial number or bar code is required by the vendor to reconcile that particular publication issue. Since the exposure of the serial number causes the publication to be defaced, it is not likely that reconciliation can occur prior to sale.

In another embodiment of the invention adapted for use with tobacco products, the pull tab is affixed directly to the inner side of the cigarette pack beneath where the required Surgeon General's warning is imprinted. Removal of the pull tab to expose the concealed reconciliation data, also removes the warning, thereby rendering the unit unsaleable.

The reconciliation system of the present invention may also be used for reconciling many other consumer products, such as over-the counter drugs, like aspirin. Today, packages or bottles of such drugs include a tamper-proof seal. Reconciliation data may be directly printed or affixed under the cap of the bottle, for example. Breaking the seal to access the reconciliation data renders the product unsaleable. Various other applications of the invention with other products whereby the package or product is defaced or destroyed, preventing resale, to reveal reconciliation data, such as a serial number or bar code, may also be realized.

In the operation of the preferred embodiment, the vendor enters a batch code which is found on the binding tape around a bundle, or on a package, or container of products such as newspapers, camera film, or cigarettes, into a centrally located computer. Such entry is preferably done via a touch tone telephone in communication with the central computer. Entry of the batch code for the bundle of, for example, newspapers after the vendor's unique personal identification number effectively activates the newspapers contained in that bundle and makes them eligible for later reconciliation.

The newspapers are then sold throughout the day. Any unsold newspapers in that activated bundle may then be reconciled. For each of the unsold newspapers, the vendor removes the pull tab from the newspaper, which typically resides proximal to the fold of the inside cover. Removal of the pull tab defaces and destroys the newspaper by separating the front page from the remainder of the newspaper issue.

The pull tab is either glued or heat sealed to the product so removal of the pull tab also removes a portion of the product. A length of string material may be easily located to remove a portion of the product, for example paper wrapping, in the region of the hidden serial number, bar code or magnetic strip. After exposure of the hidden data, the vendor accesses the central computer again, preferably by a touch tone phone, to "tone-in" his unsold product units. Again, the vendor enters in his unique identification number and then the hidden data. By virtue of the fact that each unit is part of a bundle of units assigned a batch code previously entered into the computer, it is impossible for a vendor to reconcile a unit that he or she did not, in fact, activate earlier. If the serial number that is entered falls within one of the batch codes entered earlier by the vendor, it will be deemed a legal transaction and reconciliation credit will be received by the vendor instantaneously.

It is therefore an object of the present invention to provide an automated reconciliation system that may be operated simply and easily by a vendor without having to physically return a "proof of purchase" detachment from the unsold product or actual unsold product units.

An additional object of the present invention is to provide an automated publication reconciliation system that may be easily operated by vendors without mailing in torn mastheads or covers for reimbursement.

Another object of the present invention is to provide an automated reconciliation system which provides instantaneous reimbursement for unsold units.

It is a further object of the present invention to provide an automated reconciliation system which prevents fraudulent or unauthorized reconciliation of stolen or diverted units.

It is yet a further object of the present invention to provide an automated reconciliation system that prevents the reconciliation for credit of units that have been already sold.

It is another object of the present invention to provide an automated reconciliation system that requires the unsold unit to be irreparably defaced rendering it impossible to resell after reconciliation.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
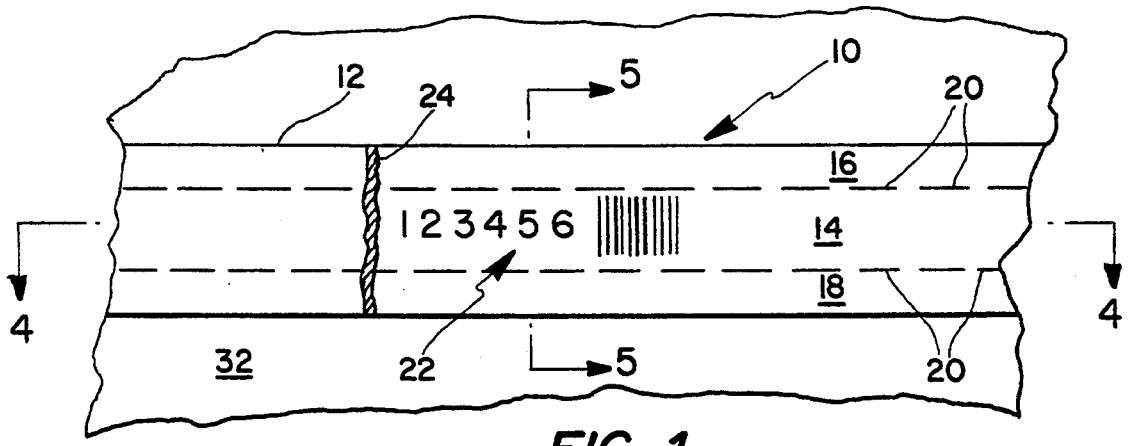
FIG. 1 is a plan view of the underside of the pull tab of the present invention.

Referring first to FIG. 1, the pull tab strip 10 of the present invention is generally shown to include a sheet of material 12 which is divided into three sections. A central portion 14 is connected on its top and bottom edges by outer portions 16 and 18. Preferably, the entire sheet of material 12 is divided into central portion 14 and outer portions 16 and 18 by starting with a single sheet of material and creating perforations or cut slits 20 to divide sheet 12 into three easily separable portions.

Preferably, the pull tab 10 is approximately three-quarters of an inch wide with perforations a minimum of one-eighth of an inch in from the top and bottom sides of sheet 12. As a result, central portion 14 is preferably one-half of an inch wide while the outer portions 14 and 16 are each one-eighth of an inch wide. The perforations 20 are preferably three inches long with a gap of one-sixteenth of an inch from perforation to perforation. Alternatively, the perforations 20 may be slits cut completely through sheet 12. Such perforations 20 provide easy separation of central portion 14 from outer portion 16 and 18 upon removal of pull tab strip from the product as will be discussed in detail below. The pull tab is preferably manufactured of heavy grade or reinforced newsprint, stiff paper or tape to insure that the pull tab strip 10 is stronger than the product, product covering or product packaging on which it is affixed. The dimensions and materials of pull tab 10 may be modified to adapt to various products which differ in size, shape and construction.

Figure 16:
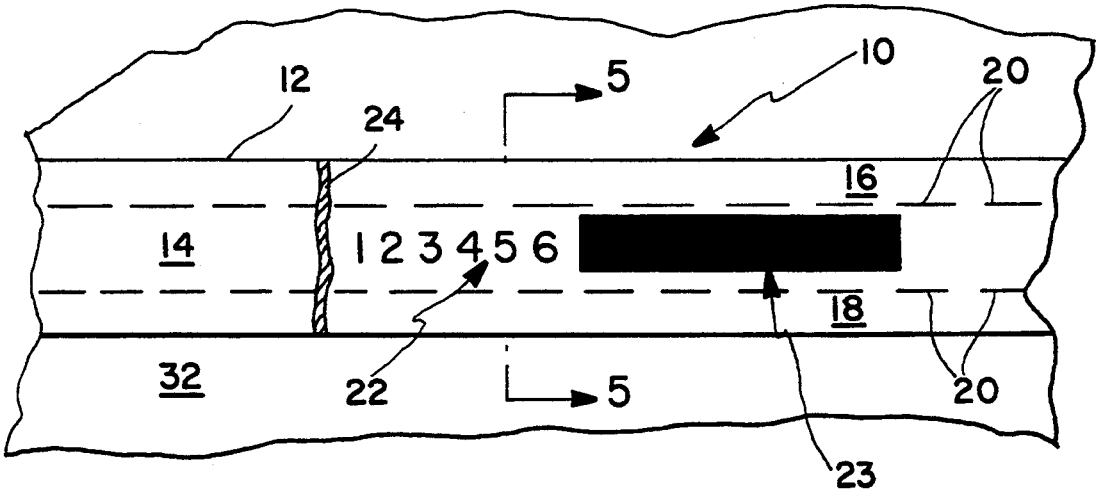
FIG. 16 is a plan view of the underside of an alternative embodiment of the pull tab of the present invention with magnetic strip thereon.

Still referring to FIG. 1, on the central portion 14 of pull tab strip 10 is reconciliation data 22 which may be in the form of a serial number, bar code or any machine readable coding. The reconciliation data 22, in the form of a serial number or bar code, is preferably printed directly on the unexposed side of the pull tab 10 which can be effectively accomplished through high speed ink jet printing or any similar process. In addition, the reconciliation data 22 may be printed on a separate label which is then attached to central portion 14 of pull tab 10. Alternatively, reconciliation data 22 may be carried on a magnetic strip 23, as shown in FIG. 16, which may be directly affixed to central portion 14 to permit magnetic readers to receive reconciliation data 22. Also, reconciliation data 22 may be carried directly on a product itself with pull tab 10 being blank and positioned to cover reconciliation data 22.

Adhered to sheet 12 across central portion 14 and outer portions 16 and 18 is string 24 to facilitate exposure of reconciliation data which is hidden between sheet 12 and a product onto which it is affixed. String 24 may be textile material, cellophane, plastic, metal, wire or the like. Details of the operation of string 24 will be described in conjunction of the operation of the present invention below.

Figure 2:
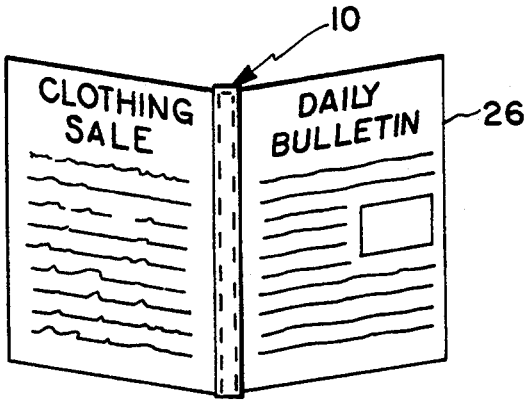
FIG. 2 is a perspective view of a newspaper carrying the pull tab of FIG. 1.

The present invention has particular application in the automatic reconciliation of publications, such as newspapers. Turning now to FIG. 2, by way of example, the preferred embodiment of the present invention is shown on newspaper publication 26. Pull tab 10 is located proximal to the central fold of newspaper 26. In this newspaper implementation, the pull tab strip 10 is preferably located on the inside of the cover page running down the spine from top to bottom. The width of the pull tab is as wide as the space between the columns of the inside front page and inside last page would allow. Optimally, sheet 12 of pull tab 10 is the same color as the newsprint but could also be other colors. Also, the columns on the front and reverse sides of the cover page may be offset in relation to the spine so when the pull tab 10 is removed, an amount of the left-most column on the front page is removed as well.

In similar fashion to the use of the pull tab strip 10 on a newspaper publication 26, it could be employed in a magazine publication In this magazine implementation, the pull tab 10 is attached on the inside of the cover, running down the spine from top to bottom. Depending on the style of the binding, the pull tab 10 may be either centered or off-center down the spine. The width of the pull tab 10 should be as wide as possible, balancing destruction to the cover with attractiveness of the inside of the periodical. The die-cut slits or perforations 20 along pull tab 10 may be either straight, angled or any other design which would increase the destruction to the magazine when pull tab 10 is removed. Alternatively, pull string arrangement could be employed as well for ease of removal of the pull tab 10. Due to the material used for magazine cover stock, plastic tape, poster board or similar material is preferred as the pull tab material. In addition, the exterior of pull tab 10 affixed to the inside cover of a magazine may be decorative to improve the overall aesthetics of the inside cover.

In both of the foregoing newspaper and magazine implementations of the invention, the stock of the publication may be thinner or lighter in weight to ensure that removal of the adhered pull tab destroys or defaces the publication. The manufacturer of the stock may provide that a portion of the publication material be weakened where the pull tab 10 will be affixed while the remainder of the stock retain a stronger character. Further, important information, such as price, date and edition, may be printed on the outer cover of the publication in the area above the pull tab 10, so upon removal of the tab, the information is removed as well.

Figure 3:
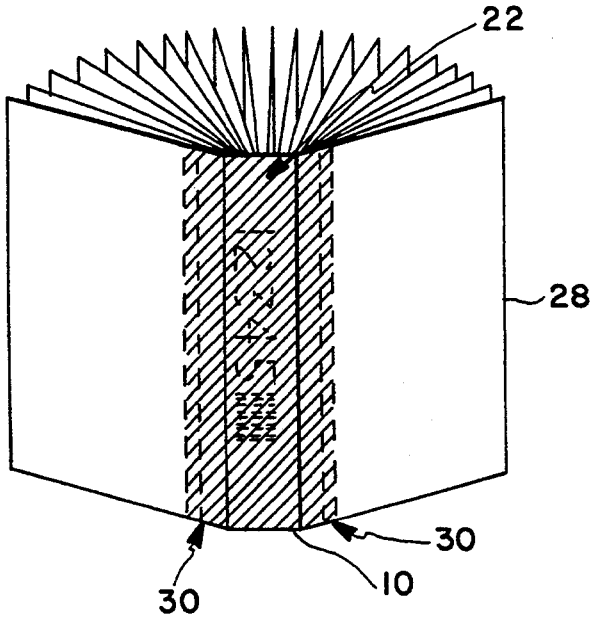
FIG. 3 is a perspective view of an alternative embodiment of the present invention with the pull tab of FIG. 1 located in the binding of a book.

Turning now to FIG. 3, a paperback book implementation of the present invention is shown. Book 28 includes pull tab strip 10 attached on the inside of the cover, running down the center of the binding front top to bottom extending to portions 30 on both the front and back cover. Upon removal of pull tab 10 for exposure of reconciliation data 22, pull tab 10 separates both the front and back cover to completely destroy the binding To facilitate the removal of pull tab 10 in this book implementation, both covers may be opened parallel with the binding and then the pull tab 10 would be drawn. In addition, the binding of book 28 may be weakened to ease the pulling of pull tab 10. In particular, the width of pull tab 10 in tills embodiment is as wide as possible, balancing destruction to the cover with the aesthetics of the inside of the paperback. In similar fashion to the magazine implementation of the invention, die-cut slits or perforations 20 running along the sides of sheet 12 may be either straight, angled or of any other design which would increase destruction of the cover when pull tab 10 is removed. Further, an attached pull string (not shown) may be directly affixed to pull tab 10 to facilitate removal of it from the cover of book 28. In this embodiment, heavy cardboard stock, plastic or nylon strips are preferred as the pull tab materials due to their strength.

Most unsold paperback books today are reconciled by tearing just the front cover of the book and sending it back to the publisher for reconciliation credit. However, there is a large overseas market for such "unsold" books which have already received reconciliation credit. It is clear that mere removal of just the front cover does not effectively deter fraudulent post-reconciliation sales. In this paperback implementation, the present invention requires severe destruction to both the front and back covers of the book in order to expose reconciliation data 22 and to ultimately obtain reconciliation credit. As a result, fraudulent resale of previously reconciled books is greatly diminished.

Figure 4:
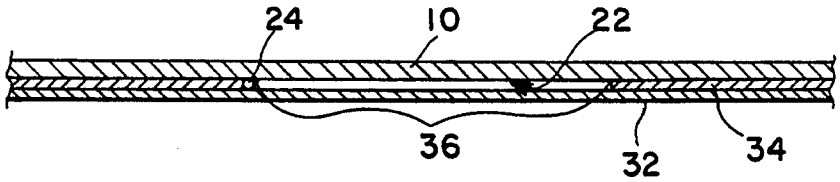
FIG. 4 is a cross sectional view of FIG. 1 through line 4—4.
Figure 5:
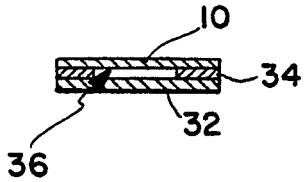
FIG. 5 is a cross sectional view of FIG. 1 through line, 5—5.

In FIG. 4, the cross-sectional view of line 4—4 in FIG. 1 is shown to illustrate the structure of how pull tab 10 is affixed to a product, such as a publication 32. As can be seen, pull tab 10 is affixed to publication 32 by adhesive 34 which may be glue, paste or the like. Adhesive 34 adheres the entire surface of pull tab strip 10 to publication 32 with the exception of data area 36 which is in the region where reconciliation data 22 resides on pull tab strip 10. As can also be seen in FIG. 5, which is a cross-sectional view of FIG. 1 through line 5—5, pull tab 10 is adhered to publication 32 in all areas except data area 36 which contains reconciliation data 22 for later exposure. Adhesive 34 binds the pull tab 10 strongly to publication 32 so that it cannot be pulled off and still leave the cover or front page of the publication intact. It should be understood that pull tab 10 is similarly affixed to a non-publication product such as cigarette packs and medicine packages and containers. In these embodiments, pull tab 10 operates in identical fashion to its operation in a publication application of the invention.

Figure 6:
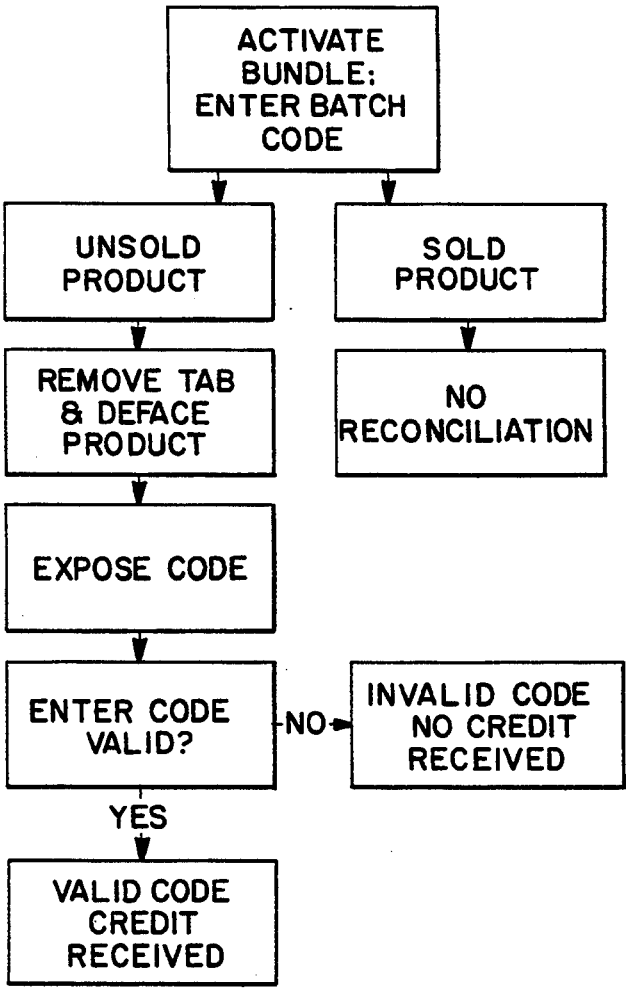
FIG. 6 is a block diagram indicating the preferred process of the present invention.
Figure 8:
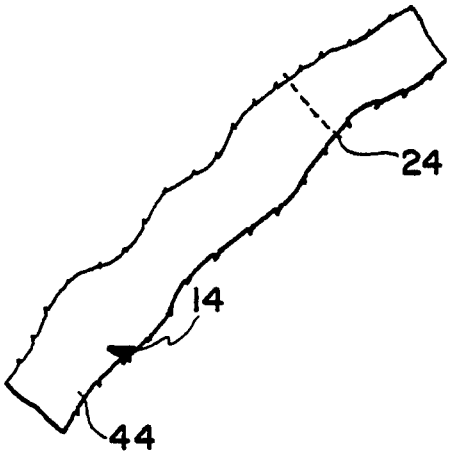
FIG. 8 is a perspective view of a pull tab fully removed from a publication.
Figure 9:
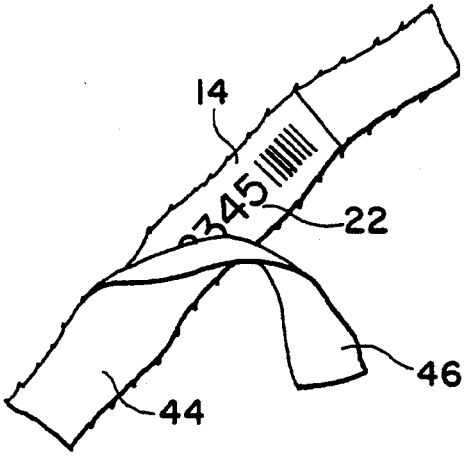
FIG. 9 is a perspective view of a pull tab with hidden data exposed.
Figure 10:
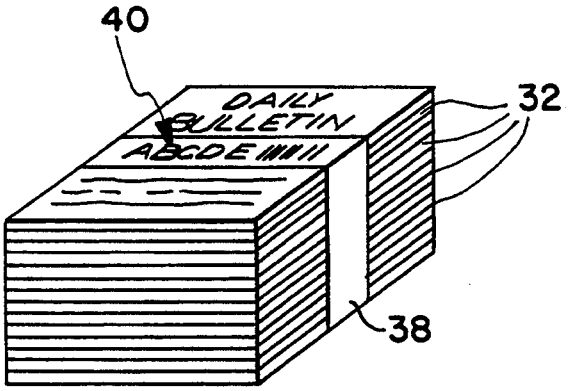
FIG. 10 is a perspective view of a bundle of newspapers with a batch code number on the binder.

Referring now to FIGS. 6–10, the preferred operation of the present invention will be discussed in detail below. FIG. 6 illustrates a block: diagram outlining the steps of operation of the automated reconciliation system of the present invention. As seen in FIG. 10, it is preferred that a particular group or lot of units, where each unit therein has a pull tab 10 installed, are grouped into a single batch bundle. For example, FIG. 10 illustrates a newspaper publication implementation where newspapers are grouped into a bundle and bound by strap 38. Alternatively, for example, in a book implementation, a group of books may be grouped into a single container box or shrink-wrapped together. Strap 38 carries a batch code 40 for identifying the entire bundle of publications 32 as well as their respective reconciliation data 22 contained on each pull tab strip 10. Where the group of products, such as cigarette cannons, are shrink-wrapped or contained in a box, batch code data 40 may be printed directly on the box or printed on a label which is then affixed to the box or shrink-wrapped bundle. Therefore, it should be understood that various means to group a lot of units together may be employed where batch code 40 effectively serves to identify that group or lot of the product.

By way of example, a newspaper implementation will be described to illustrate the operation of the present invention. At the beginning of the day, a vendor would receive bundles of the day's newspapers, with each newspaper therein containing a pull tab 10 with individual reconciliation data 22 thereon. Each bundle carries a batch code 40. The vendor activates each bundle by entering each batch code 40 into a central computer after he or she has entered his personal vendor identification number. Such entry, can be accomplished through a touch tone phone by touch toning in the batch code. Alternatively, the vendor may bar scan or magnetically read the batch code into the computer along with their agent or vendor identification number. As a result of this entry, the vendor has "activated" each bundle and has effectively confirmed that the vendor has received and intends to sell the particular publications contained therein. Additionally, this activation process can verify whether the vendor is authorized to sell the particular bundles of newspapers.

Figure 7:
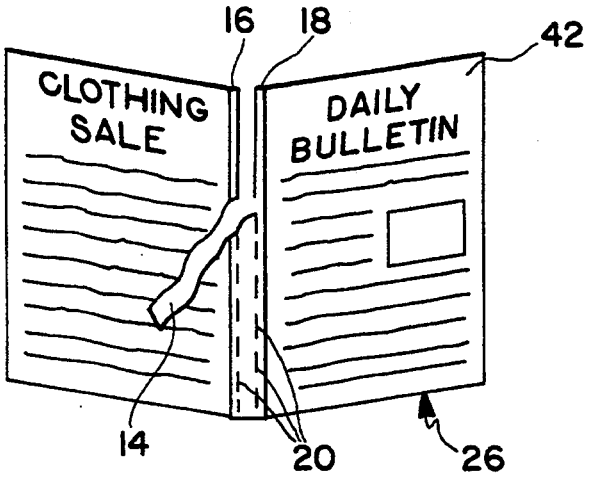
FIG. 7 is a perspective view of a newspaper with a pull tab of the present invention partially removed.

At the end of the day, the vendor begins the process for reconciling unsold newspapers. As seen in FIG. 7, pull tab 10 is drawn in a downward fashion to separate central portion 14 from outer portions 16 and 18 along perforations 20. When central portion 14 is completely drawn, front page 42 is completely severed from the remainder of the newspaper, rendering it unsaleable. Once the central portion 14 of pull tab 10 has been removed, hidden reconciliation data is exposed, as seen in FIGS. 8 and 9, by pulling on string 24 to locate the reconciliation data 22 and to peel away newspaper strip 44 which was glued to pull tab strip 10 and ripped away from the remainder of the newspaper when the pull tab strip was removed. As can be seen in FIG. 9, pulling of string 24 releases flap 46 of newspaper material to expose central portion 14 and reconciliation data thereon.

Alternatively, reconciliation data 22 may be printed directly on the product unit with pull tab 10 being blank for ease of implementation. As a result, data 22 is still concealed requiring removal of pull tab 10 to effect exposure of reconciliation data 22. Reconciliation data 22 may also be printed directly on the product unit or packaging, or on an attached pull tab, wherein the data is concealed within a sealed unit, requiring either the unit or its packaging to be irreparably defaced to effect exposure of reconciliation data 22.

Figure 12:
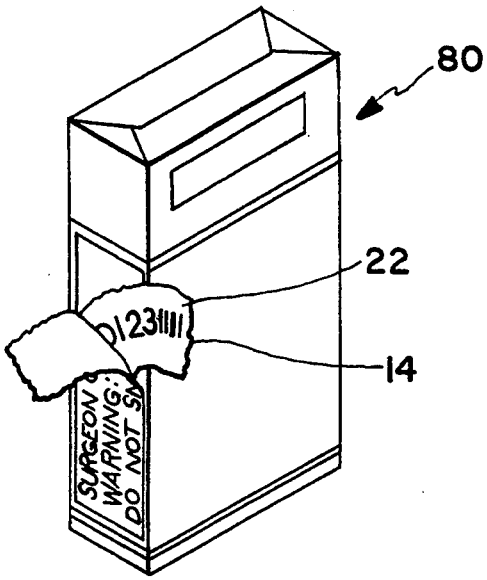
FIG. 12 is a perspective view of a pack of tobacco cigarettes employing the automated reconciliation system of the present invention.

As seen in FIG. 12, if the vendor is reconciling a pack of cigarettes which carry an expired date, central portion 14 of pull tab 10 is pulled away from the cigarette pack 80 thereby tearing the cigarette pack. After a string 24 is drawn, the reconciliation data 22 is exposed permitting the vendor to reconcile the pack while destroying the package to prevent fraudulent resale. Pull tab may be placed within the pack beneath where the Surgeon General's warning, required on cigarette packages, resides, so, upon removal, the warning is removed as well, rendering the pack unsaleable.

Figure 13:
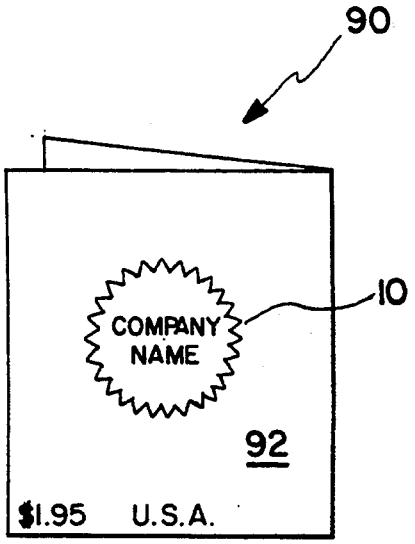
FIG. 13 is a perspective view of a greeting card employing the automated reconciliation system of the present invention.

FIG. 13 illustrates a further embodiment of the present invention with a modified pull tab 10 s on greeting card 90. In this embodiment, pull tab 10 is preferably circular and affixed directly to the back side 92 of greeting card 90. Concealed reconciliation data 22 (not shown in FIG. 13) is printed on the unexposed side of pull tab 10 which is, in this embodiment, a foil authenticity seal, affixed to the back side of greeting card 90. Upon removal of pull tab 10, in the form of a seal, a string 24 is drawn to reveal reconciliation data 22 and the card 90 is defaced and rendered unsaleable.

Figure 14:
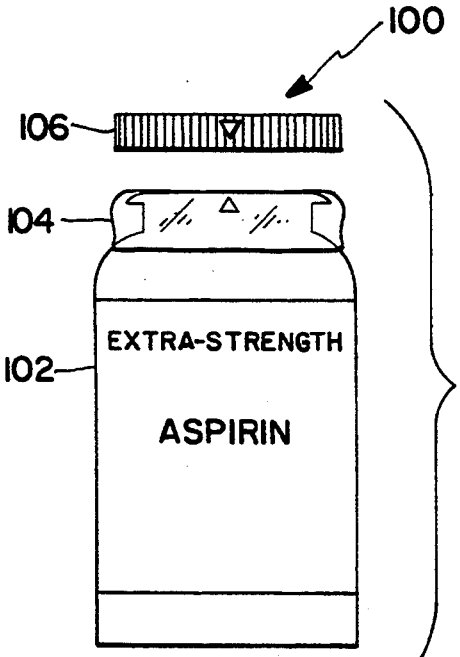
FIG. 14 is a side view of an over-the-counter drug package employing the automated reconciliation system of the present invention.
Figure 15:
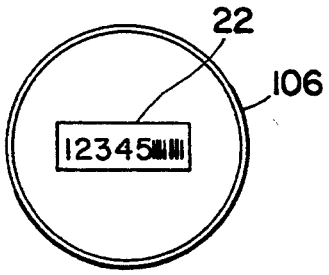
FIG. 15 is a bottom view of a cap of the drug package of FIG. 14.

FIGS. 14 and 15 show a further embodiment of the present invention where a packaged drug, such as aspirin, includes visible reconciliation data 22 on the underside of cap 106. Receptacle portion 102 of bottle 100 is filled with aspirin, for example, and the cap 106 carrying data 22 is place thereon. Protective tamper-proof seal 104 is secured about the neck of receptacle portion 102 of bottle 100 in customary fashion. Upon time for reconciliation for credit of the unused bottle, cap 106 is removed thereby breaking seal 104 to expose reconciliation data 22. Since seal 104 has been broken, product 100 is unsaleable.

The foregoing are examples of the various embodiments and applications of the present invention. Other applications may include, but are not limited to, candy; photographic film and supplies, video games; all types of electronic media, such as compact discs, audio and video cassettes, and computer software.

Now that the reconciliation data 22 has been exposed, it can be entered along with the vendor's identification number to receive reconciliation credit and instantaneous reimbursement. In similar fashion to entry of batch code 40, entry of reconciliation data 22 for each of the unsold units can be accomplished through a touch tone phone, bar scanning or any other apparatus to communicate with the central computer of the publisher, intermediary wholesaler or distributor. Upon entry of the reconciliation data 22 and after entry of the vendor's identification number, the central computer determines whether the reconciliation data that has been entered is valid by determining whether the data that has been entered corresponds to a unit that was part of a group or bundle previously activated by that vendor. A comparison occurs between the reconciliation data entered for the particular unit with a list of reconciliation data codes for the units that were part of a group or bundle previously activated by the vendor. Upon verification that the reconciliation data 22 properly corresponds to a unit in a group previously activated, reconciliation credit and instantaneous reimbursement is received by the vendor. In the event that the vendor is not authorized to reconcile the particular unit (he was not the one who previously activated the group or bundle), the transaction is flagged as illegal and the vendor will not receive the reconciliation credit requested. The combination of a non-hidden batch code 40 and hidden reconciliation data 22 on each unit in the group ensures that only groups of units delivered to the location that they were meant to be delivered to can be reconciled. Stolen or diverted units are flagged by the central computer. In similar fashion to check truncation in the banking industry, retailers and wholesalers seeking reimbursement could be required to retain and store the removed central portion 14 of pull tab 10 for later inspection and verification.

Figure 11:
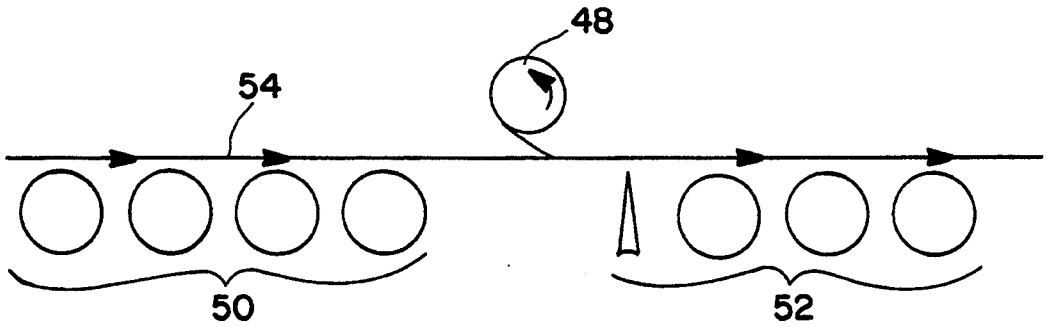
FIG. 11 is a side view of publication printing, folding and cutting stations as well as a pull tab feed roll.

Particularly when used in publications, which are printed in large volumes and at very high speed, it is preferred that each pull tab 10 is attached to the publications from a continuous feed roll with new reconciliation data synchronized with each new publication. As in FIG. 11, such a process would occur in off set printing where the publication first travels along path 54 over printing rolls 50. Next, a continuous feed roll 48 of pull tabs are affixed to the publication prior to cutting and folding at station 52. This continuous length of pull tabs is attached to the s publication and automatically draw along tile roll of the publication at whatever speed the press is being operated at. In particular, the continuous length of pull tabs are cut at both ends along with the ends of the publication itself, for example, as each individual cover page is cut by the press. Location of the reconciliation data 22 along pull tab 10 may be random to deter attempts to cut out the data 22 which is otherwise completely hidden. Marks indicating proper positioning of the pull tab 10 may be provided on the visible side of the pull tab 10 to ensure that the pull tab 10 is properly aligned and synchronized with the movement of the printed publications. A pull tab 10 may be installed into every publication printed, however, it may be desirous to restrict the installation of pull tabs 10 to certain production runs. For example, it may be desirous not to install pull tabs 10 in publications meant for subscription sale to save the cost of adding the pull as tabs 10 to publications which are not likely to be reconciled. It should be understood that various other means may be employed to automate the procedure of affixing pull tabs 10 to a unit such as heat sealing without glue or paste, or the like.

A similar scheme may be employed in attaching pull tabs to the packaging of consumer products, or onto greeting cards, for example, when such items are printed utilizing an offset press. Pull tabs could also be attached to products or packaging through use of automated label application equipment, or manually by hand. Where reconciliation data is printed directly onto a product or packaging with the data concealed within the sealed unit, high speed ink jet printing equipment may be used to print the data during the manufacturing process.

In addition to being able to quickly, easily and instantaneously receive reconciliation credit for unsold units, the present invention also provides other useful functions. For example, the serial number may also be used by advertisers for testing the effectiveness of their advertising and obtaining demographics of the product's buyers. Additionally, the reconciliation data 22 may be used for contests and lotteries. Over time, the reconciliation data obtained by a wholesaler, publisher, intermediary wholesaler, vendor, distributor, or the like may be used to optimize product delivery to each particular retailer to maximize sales and limit surplus and unsold units resulting in diminished reconciliation and costs associated therewith. Additionally, in the publication implementation, publishers could use data 22 to target single-copy retail purchasers for subscriptions. Also, automated reconciliation through a touch tone phone, bar scanner or magnetic reader, which is directly connected to a central computer, would eliminate the significant postage cost incurred by known mail-in manual reconciliation systems.

In an alternative embodiment of the present invention for publications (not shown), two lines of perforation could be cut down the cover page with a pull tab running in between them. Pulling the tab would draw the entire assembly away from the cover page, thereby destroying it. Alternatively, the cover page of a publication may be cut in half during the printing process whereby a pull tab is added to connect the two separated pieces together. Upon pulling of the pull tab, the two cover page sections would be separated rendering the publication unsaleable. In addition, an overlapping fold could be created down the cover page of the publication with a strip printed with reconciliation data implanted therein. Upon separation of the fold, the cover page would be destroyed.

It will be appreciated by those skilled in the art that various changes and modifications can be made to the illustrated embodiments without departing from the spirit of the present invention. All such modifications and changes are intended to be covered by the appended claims.

I claim:

1. A method of reconciling a product unit, comprising the steps of:

affixing a sheet of material to a product unit with hidden data disposed between said sheet of material and said product unit;

separating said sheet of material from said product unit;

defacing said product unit to render it unsaleable;

exposing said hidden data;

entering said hidden data into a computer;

confirming validity of said hidden data; and providing reconciliation credit for entry of valid hidden data.

2. The method of claim 1, further comprising the steps of:

entering batch data information assigned to a group of product units; and determining whether said product unit is in said group of units and carries valid hidden data by comparing said hidden data with said batch data.

3. The method of claim 1, further comprising the step of providing said sheet of material manufactured of paper.

4. The method of claim 1, further comprising the step of providing said sheet of material manufactured of plastic.

5. The method of claim 1, further comprising the step of providing said sheet of material manufactured of cloth.

6. The method of claim 1, further comprising the step of gluing said sheet of material to said product unit.

7. The method of claim 1, further comprising the step of heat-sealing said sheet of material to said product unit.

8. The method of claim 1, further comprising the step of providing a pack of cigarettes as said product unit.

9. The method of claim 1, further comprising the step of providing a greeting card as said product unit.

10. The method of claim 1, further comprising the step of providing a drug package as said product unit.

11. The method of claim 1, further comprising the step of providing said hidden data printed and affixed to said sheet of material.

12. The method of claim 1, further comprising the step of providing said hidden data printed and affixed to said product unit.

13. The method of claim 1, further comprising the step of providing said hidden data carried in a magnetic storage means.

14. A method of reconciling a product unit, comprising the steps of:

affixing hidden data to a product unit;

defacing said product unit to render it unsaleable;

exposing said hidden data;

entering said hidden data into a computer;

confirming validity of said hidden data; and providing reconciliation credit for entry of valid hidden data.

15. The method of claim 14, further comprising the steps of:

entering batch data information assigned to a group of product units; and determining whether said product unit is in said group of units and carries valid hidden data by comparing said hidden data with said batch data.

16. The method of claim 14, further comprising the step of providing a pack of cigarettes as said product unit.

17. The method of claim 14, further comprising the step of providing a greeting card as said product unit.

18. The method of claim 14, further comprising the step of providing a drug package as said product unit.

19. The method of claim 14, further comprising the step of providing photographic film as said product unit.

20. The method of claim 14, further comprising the step of providing said hidden data affixed to said product unit.

21. The method of claim 14, further comprising the step of providing said hidden data affixed to packaging of said product unit.

22. The method of claim 14, further comprising the step of providing said hidden data carried in a magnetic storage means.

23. An automated product unit reconciliation system, comprising:

a product unit;

a sheet of material having a first side and a second side, said first side being affixed to said product unit;

hidden information means disposed between said sheet and said product unit for reconciling said product unit with its manufacturer;

means for removing said sheet of material from said product unit;

means for irreparably defacing said product unit upon removal of said sheet of material from said product unit rendering said product unit unsaleable;

means for receiving said hidden information means;

means for confirming validity of said hidden information means; and means for providing reconciliation credit upon receipt of a valid hidden information means.

24. The system of claim 23, wherein said sheet of material is manufactured of paper.

25. The system of claim 23, wherein said sheet of material is manufactured of plastic.

26. The system of claim 23, wherein said sheet of material is manufactured of cloth.

27. The system of claim 23, wherein said sheet of material is affixed to said product unit by glue.

28. The system of claim 23, wherein said sheet of material is heat-sealed to said product unit.

29. The system of claim 23, wherein said product unit is a pack of cigarettes.

30. The system of claim 23, wherein said product unit is a greeting card.

31. The system of claim 23, wherein said product unit is a drug package.

32. The system of claim 23, wherein said information means is printed data on said first side of said sheet of material.

33. The system of claim 23, wherein said information means is printed data on said product unit.

34. The system of claim 23, wherein said information means is carried by magnetic storage means.

35. The system of claim 23, further comprising:

means for grouping a plurality of product units into a single lot;

unconcealed information means disposed on said means for grouping;

means for receiving said hidden information means means for receiving said unconcealed information means;

means for comparing said hidden information means to said unconcealed information means;

means for confirming validity of said hidden information means; and means for providing reconciliation credit upon receipt of a valid hidden information means.

36. An automated product unit reconciliation system, comprising:

a product unit;

hidden information means on said product unit for reconciling said product unit with its manufacturer;

means for revealing said hidden information means;

means for irreparably defacing said product unit upon revealing said hidden information means rendering said product unit unsaleable;

means for receiving said hidden information means;

means for confirming validity of said hidden information means; and means for providing reconciliation credit upon receipt of a valid hidden information means.

37. The system of claim 36, wherein said product unit is a pack of cigarettes.

38. The system of claim 36, wherein said product unit is a greeting card.

39. The system of claim 36, wherein said product unit is a drug package.

40. The system of claim 36, wherein said product unit is photographic film.

41. The system of claim 36, wherein said information means is printed data on said product unit.

42. The system of claim 36, wherein said information means is printed data on packaging of said product unit.

43. The system of claim 36, wherein said information means is carried by magnetic storage means.

44. The system of claim 36, further comprising:

means for grouping a plurality of product units into a single lot;

unconcealed information means disposed on said means for grouping;

means for receiving said hidden information means;

means for receiving said unconcealed information means;

means for comparing said hidden information means to said unconcealed information means;

means for confirming validity of said hidden information means; and means for providing reconciliation credit upon receipt of a valid hidden information means.

* * * * *